US005567087A

United States Patent [19]

Theisen

[11] Patent Number: 5,567,087

[45] Date of Patent: Oct. 22, 1996

[54] METHOD OF USING HIGH PROFILE GEOTEXTILE FABRICS WOVEN FROM FILAMENTS OF DIFFERING HEAT SHRINKAGE CHARACTERISTICS FOR SOIL STABILIZATION

[75] Inventor: Marc S. Theisen, Signal Mountain, Tenn.

[73] Assignee: Synthetic Industries, Inc., Chickamauga, Ga.

[21] Appl. No.: 445,177

[22] Filed: May 19, 1995

Related U.S. Application Data

[62] Division of Ser. No. 145,461, Oct. 29, 1993.

[51] Int. Cl.[6] ..... E02D 17/20; B32B 3/12

[52] U.S. Cl. ..... 405/258; 428/183; 428/257

[58] Field of Search ..... 405/258, 15, 16; 428/180–183, 257, 258, 259; 47/95, 59 SS, 56

[56] References Cited

U.S. PATENT DOCUMENTS

| | | | |
|---|---|---|---|
| 2,627,644 | 2/1953 | Foster | 428/175 |
| 2,635,648 | 4/1953 | Foster | 428/175 |
| 2,757,434 | 8/1956 | McCord et al. | 28/156 |
| 2,771,661 | 11/1956 | Foster | 428/101 |
| 3,934,421 | 1/1976 | Daimler et al. | 405/16 |
| 4,002,034 | 1/1977 | Mühring et al. | 405/19 |
| 4,022,596 | 5/1977 | Pedersen | 55/528 |
| 4,329,392 | 5/1982 | Bronner | 428/296 |
| 4,421,439 | 12/1983 | ter Burg et al. | 405/258 |
| 4,472,086 | 9/1984 | Leach | 405/258 |
| 4,762,581 | 8/1988 | Stancliffe et al. | 156/84 |
| 4,867,614 | 9/1989 | Freed | 405/263 |
| 4,929,398 | 5/1990 | Pedersen | 261/94 |
| 5,232,759 | 8/1993 | Golze | 428/89 |

FOREIGN PATENT DOCUMENTS

| | | | |
|---|---|---|---|
| 2388090 | 12/1978 | France | 405/258 |
| 156326 | 12/1981 | Japan | 405/258 |

OTHER PUBLICATIONS

Specification of Netlon Limited entitled "High Profile Structures, E.G. For Soil Retention or Drainage" (undated).

*Primary Examiner*—David J. Bagnell

*Attorney, Agent, or Firm*—Renner, Kenner, Greive, Bobak, Taylor & Weber

[57] ABSTRACT

A method for stabilizing soil and reinforcing vegetation includes placing a single-layered, three-dimensional, high-profile woven geotextile fabric into the soil. The single-layered, homogeneous fabric is woven from monofilament yarns having different heat shrinkage characteristics such that, when heated, the fabric forms a thick three-dimensional, cuspated profile. The monofilament yarns have a relatively high tensile strength and a relatively high modulus at 10 percent elongation so as to provide a fabric which is greater in strength and more dimensionally stable than other geotextile structures. Thus, the geotextile fabric is suitable for use on slopes, ditches and other embankments and surfaces where erosion control, soil stabilization and/or vegetative reinforcement may be necessary. The homogeneous, single-component nature of the fabric promotes easier handling and minimizes failure points, while offering a thick, strong and dimensionally stable product upon installation.

5 Claims, 2 Drawing Sheets

METHOD OF USING HIGH PROFILE GEOTEXTILE FABRICS WOVEN FROM FILAMENTS OF DIFFERING HEAT SHRINKAGE CHARACTERISTICS FOR SOIL STABILIZATION

This application is a division of application Ser. No. 08/145,461, filed Oct. 29, 1993.

TECHNICAL FIELD

This invention relates generally to three-dimensional, high-profile, woven geotextile structures and their method for use in soil retention and stabilization and vegetative reinforcement. More particularly, this invention relates to a generally planar, single-layered homogeneous fabric woven from monofilament yarns having different heat shrinkage characteristics such that, when heated, the fabric forms a thick three-dimensional, cuspated profile. The monofilament yarns have a relatively high tensile strength and a relatively high modulus at 10 percent elongation so as to provide a fabric which is greater in strength and more dimensionally stable than other three-dimensional, woven geotextile structures. Such a geotextile fabric is suitable for use on slopes, ditches and other embankments and surfaces where erosion control, soil stabilization and/or vegetative reinforcement may be necessary. The homogeneous, single-component nature of the fabric promotes easier handling and minimizes failure points, while offering a thick, strong and dimensionally stable product upon installation.

BACKGROUND OF THE INVENTION

Woven fabrics having heat-shrinkable yarns incorporated therein are well known. For example, at least three patents to B. H. Foster in the early 1950's (U.S. Pat. Nos. 2,627,644, 2,635,648, and 2,771,661) and one to McCord in 1956 (U.S. Pat. No. 2,757,434) use heat-shrinkable yarns along with non-heat-shrinkable yarns to make honeycombed, puffed and/or corrugated fabrics for use in bedding, clothing and the like.

In addition, woven fabrics having the same or similar general cuspated profile or "honeycomb" type weave configuration as the present invention are known in the art and are used as tower packing and/or as the separation medium in mist eliminators. For instance, Pedersen U.S. Pat. No. 4,002,596 relates to a fluid treating medium through which fluid may pass for removing particulate material from the fluid. The material used is comprised of at least two sets of strands interleaved together in a particular configuration to each other so that the strands extending in one direction are generally straight while the strands extending in another direction are geometrically arranged so as to provide a fabric having a cuspated configuration or profile. The fabric of the present invention is similar in profile except it may bend the strands of yarn in both directions.

Nevertheless, other fabrics do in fact have similar configurations or profiles. However, they are typically used in mist eliminators and other apparatus where separation medium of this type may be required. At least one such fabric is available from the Lureitc Division of Synthetic Industries of Gainesville, Ga. Notably, however, none of these fabrics have ever been used for soil retention and stabilization or turf reinforcement. Significantly, this is because the yarns used to make these fabrics are not strong enough or do not form fabrics which are thick and durable enough or dimensionally stable enough to withstand the extremely rugged conditions exhibited within soil embankments and the like. In other words, these fabrics are not high-profile structures. A high-profile structure has a thickness considerably greater than that of an ordinary "honeycomb" woven fabric. It is this thickness in combination with the strength and dimensional stability of the fabric which permits the fabric to restrain the movement of soil or gravel filling the space defined by the fabric on a steep slope or embankment.

Also of major importance to the use of fabrics in soil design and performance are weight, strength, and modulus. It is a combination of these properties, including thickness, which determines whether a geotextile fabric will be suitable for use in soil retention and stabilization as well as turf reinforcement. Desirably, a fabric having a typical tensile strength of at least about 3200×2400 pounds per foot (warp×fill, respectively) as determined by the American Society for Testing and Materials' (ASTM) Standard Test Method D4595, a modulus of at least about 10000 pounds per foot determined by ASTM D4595 at 10 percent elongation, and a thickness of at least about 500 mils (0.5 inches) determined by ASTM D1777 is necessary to provide soil stabilization and erosion control on slopes, embankments, subgrades and veneer layers in places such as landfills. While some mattings and other similar structures have, heretofore, been used to aid in soil retention or erosion control, most of these structures have been generally ineffective in providing true stability and reinforcement for the soil. In fact, most of the prior art structures have employed generally straight yarns in at least one direction, are not heat-shrinkable, and/or have filaments which are melt-bonded together so as to cause failure points to exist with respect to the bonding of the fabric.

For example, Daimler et al. U.S. Pat. No. 3,934,421 discloses a matting comprising a plurality of continuous amorphous synthetic thermoplastic filaments which are bonded together at their intersections and can be used for the ground stabilization of road beds.

Murhling et al. U.S. Pat. No. 4,002,034 is directed toward a multi-layered matting for inhibiting the erosion of an embankment around a body of water, the layer closest to the water having less pore space and thinner fibers than the layers away from the water.

Bronner U.S. Pat. No. 4,329,392 discloses a hydraulic engineering matting for inhibiting rearrangement of soil particles comprising a layer of melt-spun synthetic polymer filaments bonded at their points of intersection, a filter layer of fine fibers bonded thereto, and a third layer interdispersed therethrough.

Ter Burg et al. U.S. Pat. No. 4,421,439 discloses a supporting fabric or matting for use on embankments of roads, dikes, and the like. The fabric generally includes straight yarns in both the warp and weft directions with binder yarns extending in the warp direction and woven around the straight yarns of the weft direction. However, these yarns do not impart strength to the straight yarns.

Leach U.S. Pat. No. 4,472,086 is directed toward a geotextile fabric for erosion control having uncrimped synthetic threads in both the warp and filling directions and a known yarn stitch bonding the warp and filling threads together.

Finally, a commercially known high-profile structure generally used for soil retention and erosion control which does employ heat-shrinkable yarns, but not in a single layer, is disclosed in Stancliffe et al. U.S. Pat. No. 4,762,581. This patent relates to high-profile structures or composites which are noted to be useful as carpet underlay and mattresses as well as embodiment stabilization and drainage. These structures are believed to be commercially sold under the tradename, Tensat, and are available from Netlon Limited of Mill Hill, England.

However, the structures in Stancliffe et al. are provided by the welding of a planar, biaxially heat-shrinkable, plastic mesh layer to a planar, relatively non-heat-shrinkable plastic mesh layer at zones which are spaced apart on a generally square grid. Hence, when the heat-shrinkable layer is heated and shrinks, the non-heat-shrinkable layer assumes a generally cuspated configuration with the welded points on the non-heat-shrinkable layer remaining in contact with the heat-shrinkable layer. This patent does not provide a single layer fabric and is susceptible to failure at the welding points bonding the layers together.

Thus, while attempts have been made heretofore to provide a suitable means for stabilizing and retaining soil and for reinforcing turf, the art has not provided a facile means by which to do so. Accordingly, a need clearly exists for a single-layered, high-profile, three-dimensional, homogeneous fabric comprising fibers of differing heat shrinkage characteristics which will increase dimensional stability and last longer than other high-profile structures commonly utilized for soil retention and vegetative reinforcement.

SUMMARY OF INVENTION

It is, therefore, an object of the present invention to provide a three-dimensional, high-profile, woven geotextile fabric suitable for use in soil retention and stabilization and vegetative reinforcement.

It is another object of the present invention to provide a geotextile fabric, as above, woven from monofilament yarns having different heat shrinkage characteristics such that, when heated, the fabric forms a thick three-dimensional, cuspated profile.

It is yet another object of the present invention to provide a geotextile fabric, as above, which is single-layered and which has improved tensile strength, modulus, and dimensional stability, in combination, as compared to other single-layered fabrics.

It is still another object of the present invention to provide a geotextile fabric, as above, which promotes easier handling and minimizes failure points, while offering a thick, strong and dimensionally stable product upon installation on slopes, in ditches, and other like places where erosion control, turf reinforcement, and soil stabilization may be necessary.

It is yet another object to provide a method for retaining and stabilizing soil, and reinforcing turf and vegetation, by placing a three-dimensional, high-profile, woven geotextile fabric into the soil.

At least one or more of the foregoing objects, together with the advantages thereof over the known art relating to geotextile fabrics, which shall become apparent from the specification which follows, are accomplished by the invention as hereinafter described and claimed.

In general, the present invention provides a method of stabilizing soil and reinforcing vegetation comprising the step of placing a single-layered, three-dimensional, high-profile woven fabric into soil.

The present invention also includes a geotextile fabric comprising two sets of monofilaments interwoven in substantially perpendicular direction to each other, each of the monofilaments having a pre-determined, different heat shrinkage characteristics such that, upon heating, the fabric forms a single-layer, three-dimensional, cuspated profile; the fabric having a tensile strength of at least about 3200 pounds/foot in the warp direction and at least about 2400 pounds/foot in the filling direction, a modulus at 10 percent elongation of at least about 12500 pounds/foot in the warp direction and at least about 11000 pounds/foot in the filling direction, and a thickness of at least about 500 mils.

PREFERRED EMBODIMENT FOR CARRYING OUT THE INVENTION

As noted hereinabove, heretofore, mattings or geotextile structures suitable for use in the stabilization and revegetation of soil have been largely multi-layered, high-profile composite structures. The non-homogeneous nature of these composite structures as well as the possibility of weld failure in instances where the layers are bonded together are but two undesirable characteristics often found in these structures. Accordingly, a single-layered, homogeneous, high-profile, woven geotextile fabric (not a composite) as the fabric of the present invention would appear to overcome these undesirable characteristics, thereby improving the geotextile art.

Figure 2:
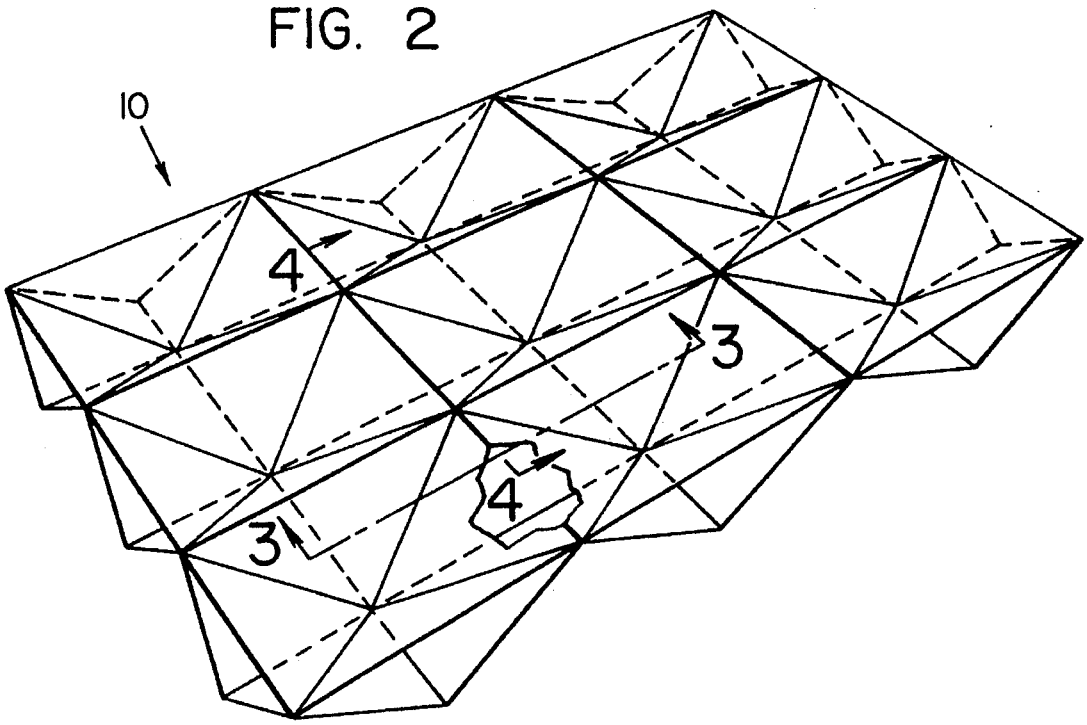
FIG. 2 is a schematic view of the fabric of FIG. 1 showing its general configuration.

A geotextile fabric embodying the concepts of the present invention is generally indicated by the numeral 10 in the accompanying drawings and includes two sets of filaments 12 and 14 interwoven in substantially perpendicular directions to each other. As best shown in FIG. 2, the filaments or fibers are initially, preferably woven into a type of pattern known in the weaving art as a "waffle weave" or "honeycomb" type of woven pattern. This weaving procedure, which is well known in the art and can be performed on essentially any conventional textile weaving apparatus, produces a generally planar fabric with a distinctive look of adjacent pyramids on one side of the fabric which oppose and are offset from adjacent pyramids on the other side of the fabric.

Figure 1:
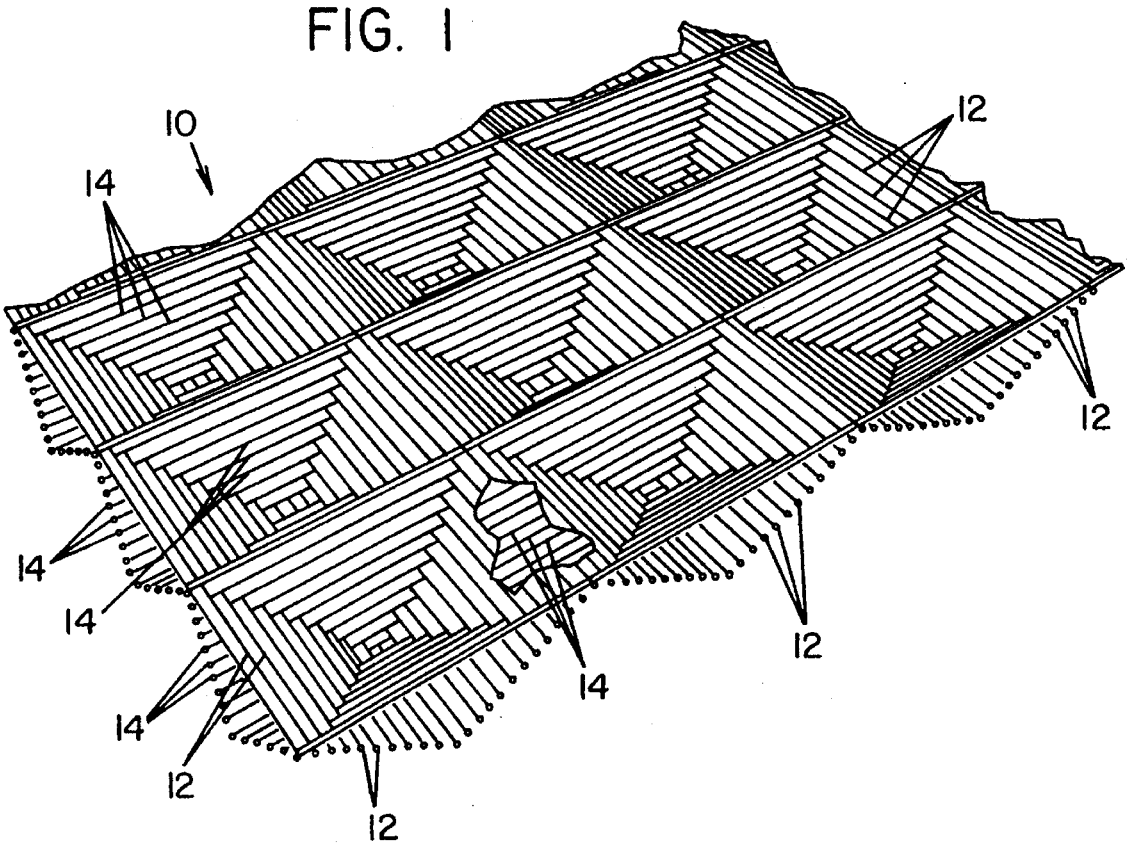
FIG. 1 is a perspective view of the fabric of the present invention.
Figure 3:
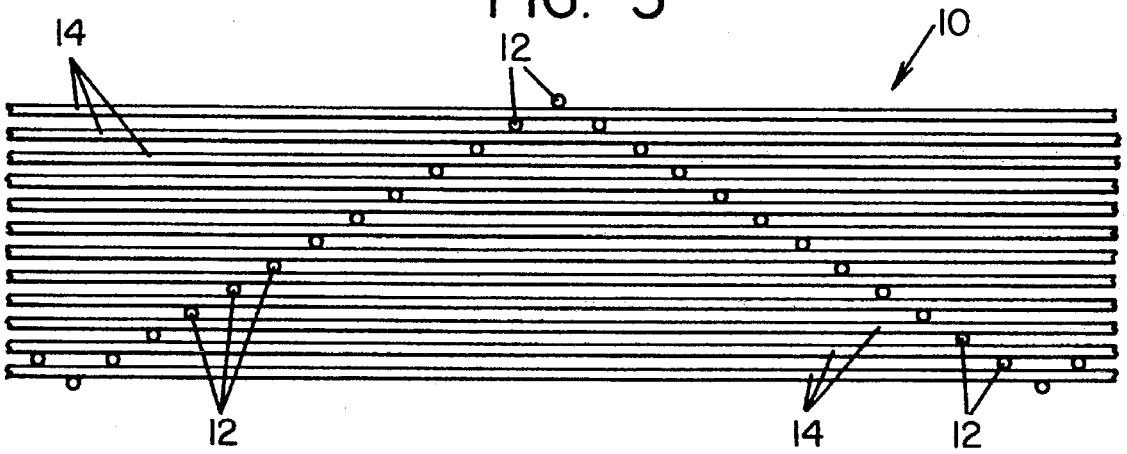
FIG. 3 is an enlarged sectional view taken substantially along line 3—3 in FIG. 2.
Figure 4:
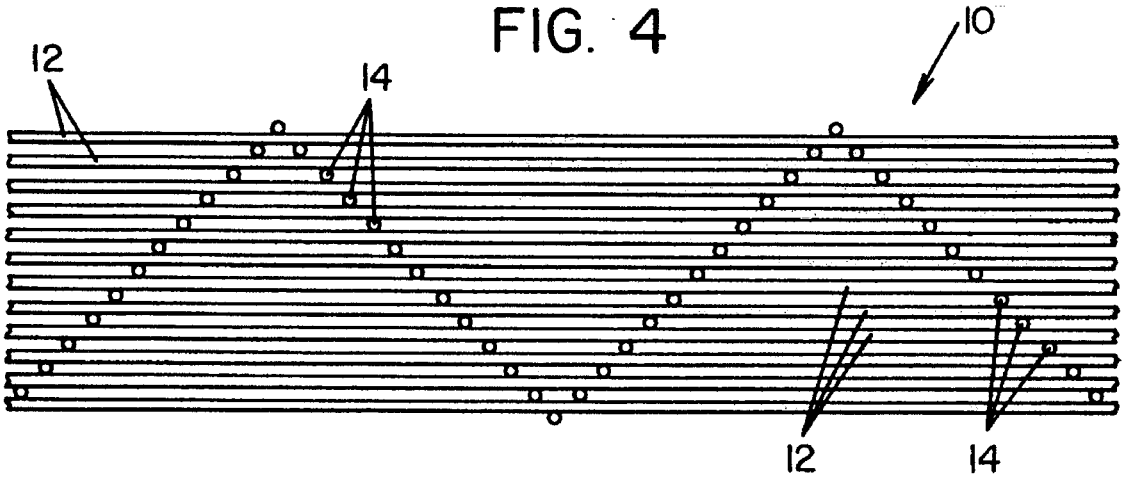
FIG. 4 is an enlarged sectional view taken substantially along line 4—4 in FIG. 2.

Importantly, the filaments utilized to produce the geotextile fabric of the present invention are biaxially heat shrinkable. That is, upon being heated, the filament yarns will shrink in both directions. However, the amount of heat shrinkage is different for each filament depending upon its position within the woven fabric. Hence, when the woven, initially planar fabric 10 is subjected to heat, preferably from a hot steam or water bath, the filaments are shrunk proportionally to the differing levels of heat shrinkage with which each filament was provided. Significantly, by arranging the filaments in a predetermined, well-known fashion based upon their level of heat shrinkage, the initially planar geotextile fabric 10 becomes thicker and more three-dimensional in shape. As seen in FIGS. 3 and 4, the filaments provide a zig-zag cross-section and take up a substantially greater volume than when the fabric is relatively planar. Consequently, a three-dimensional, high-profile woven geotextile fabric is formed as shown in FIG. 1.

Moreover, the distinctive look of the fabric becomes more pronounced. That is, the pyramidal shapes within the fabric become significantly deeper and more defined. The thickness of the geotextile fabric preferably should grow to at least about 0.5 inches (500 mils) and more preferably, to about 0.65 inches (650 mils). It is this thickness as well as other characteristics of this fabric which permit its use for soil retention and turf reinforcement.

For instance, the fabric of the present invention preferably should have a tensile strength of at least about 3200 pounds/foot in the warp direction and at least about 2400 pounds/foot in the filling direction using the American Society for Testing and Materials' (ASTM) Standard Test Method D-4595. It should also preferably have a modulus at 10% elongation of at least about 12500 pounds/foot in the warp direction and at least about 11000 pounds/foot in the filling direction using the same ASTM Test Method, D-4595.

More desirably, the fabric has a tensile strength of at least about 4700 pounds/foot in the warp direction and at least about 3500 pounds/foot in the filling direction using ASTM Standard Test Method D-4595. It should also preferably have a modulus at 10% elongation of at least about 18500 pounds/foot in the warp direction and at least about 16000 pounds/foot in the filling direction using the stone ASTM Test Method, D-4595.

At this point, it should be noted that the filaments utilized in the geotextile fabric of the present invention are preferably thermoplastic monofilament yarns comprising such materials as polyethylene and polypropylene homopolymers, polyesters, polyphenylene oxide, certain fluoropolymers, and mixtures thereof. However, it will be understood that any materials capable of producing filaments or fibers suitable for use in the instant fabric of the present invention fall within the scope of the present invention and can be determined without departing from the spirit thereof. Most preferably, the filaments of the present invention are made of polypropylene, polyethylene, high tenacity polyester, or mixtures thereof.

Moreover, before more specifically detailing the operation of the present invention, it should be understood that the process for making the geotextile fabric is well known in the art. As noted hereinabove, the weaving process can be performed on any conventional textile handling equipment suitable for producing the fabric of the present invention and thus, a "honeycomb" type weave produced from thermoplastic polymeric yarns is also well-known in the art. However, it should be understood that no single-layered, homogeneous fabric has been employed for the purposes of the present invention. Importantly, because of the increased thickness of the fabric provided by the shrinkage of the pre-arranged filaments employed therein when subjected to heat, the subject invention can be utilized in erosion control and veneer cover soil and stability applications.

In order to demonstrate that the geotextile fabric of the present invention is suitable for its intended use, several tests on two fabrics produced according to the present invention were conducted. First, several tests were performed on Fabric 1, a three-dimensional, high-profile, woven polypropylene fabric. These tests were conducted according to standard test methods provided by the ASTM. The results of these tests as well as the test methods employed are presented in Table I hereinbelow.

TABLE I

| Fabric 1 Characteristics | | |
|---|---|---|
| PROPERTY | TEST METHOD | VALUE |
| Thickness | ASTM D-1777 | 0.65 in |
| Resiliency[1] | ASTM D-1777 | 85% |
| Weight | ASTM D-3776 | 15.25 oz/sq. yd. |
| Tensile Strenth[2] | ASTM D-4632 | 400 × 300 lbs |
| | ASTM D-4595 | 4,700 × 3,500 lbs/ft |
| Tensile Elongation[2] | ASTM D-4632 | 35% |
| | ASTM D-4595 | 25% |
| Modulus at 10% Elongation[2] | ASTM D-4595 | 18,500 × 16,000 lbs/ft |
| Ground Cover Factor[3] | Light Projection Analysis | 80% |
| UV Stability[4] | ASTM D-4355 | 80% |

[1]Resiliency defined as percent of original thickness retained after 3 cycles of a 100 psi load for 60 seconds followed by 60 seconds without load - thickness being measured 30 minutes after load removed by ASTM D-1777.
[2]Values for both machine and cross machine directions under dry or saturated conditions.
[3]Ground Cover Factor represents "% shade" from Lumite Light Projection Test.
[4]Tensile strength retained after 1000 hours in a Xenon ARC Weatherometer.

Next, several of the same tests were conducted on Fabric 2, a higher-strength, three-dimensional, high-profile woven fabric comprising high tenacity polyester and polypropylene. The results of these tests as well as the test methods employed are presented in Table II hereinbelow.

TABLE II

| Fabric 2 Characteristics | | |
|---|---|---|
| PROPERTY | TEST METHOD | VALUE |
| Thickness | ASTM D-1777 | 0.65 in |
| Resiliency[1] | ASTM D-1777 | 85% |
| Weight | ASTM D-3776 | 18.5 oz/sq. yd. |
| Tensile Strenth[2] | ASTM D-4632 | 700 × 325 lbs |
| | ASTM D-4595 | 7,100 × 3,200 lbs/ft |
| Tensile Elongation[2] | ASTM D-4632 | 30% |
| | ASTM D-4595 | 15% |
| Modulus at 10% Elongation[3] | ASTM D-4595 | 49,500 × 22,500 lbs/ft |
| Ground Cover Factor[4] | Liht Projection Analysis | 80% |
| UV Stability[5] | ASTM D-4355 | 80% |
| Aperture Size | Measured | 1.0 × 1.5 in |

[1]Resiliency defined as percent of original thickness retained after 3 cycles of a 100 psi load for 60 seconds followed by 60 seconds without load - thickness being measured 30 minutes after load removed by ASTM D-1777.
[2]Values for both machine and cross machine directions.
[3]Estimated values for both machine and cross machine directions based upon limited testing.
[4]Ground Cover Factor represents "% shade" from Lumite Light Projection Test.
[5]Tensile strength retained after 1000 hours in a Xenon ARC Weatherometer.

The resulting characteristics of the three-dimensional, high-profile Fabrics 1 and 2 were then compared to other fabrics similarly produced for other purposes, such as separation medium and tower packing. These conventional fabrics were produced by the Lumite Division of Synthetic Industries. The weight, thickness, tensile strength and UV stability of these fabrics are shown in Table III hereinbelow.

TABLE III

| PROPERTY | Three Lumite Fabrics FABRIC A | FABRIC B | FABRIC C |
|---|---|---|---|
| Weight (oz/sq. yd.) | 5.5 | 7.3 | 11.6 |
| Thickness (mils) | 65 | 60 | 200 |
| Tensile Strength (lbs/ft) | | | |
| Warp | 2,280 | 3,960 | 6,000 |
| Fill | 2,400 | 2,400 | 4,140 |
| UV Stability | Poor | Poor | Poor |

Most notably, these known fabrics have a thickness generally of less than 200 mils (0.2 inches). Thus, the fabric of the present invention is three times as thick as the well-known Lumite fabrics. Moreover, Fabrics 1 and 2 have excellent ultraviolet stability while the Lurite fabrics tend to degrade much faster when subjected to ultraviolet light. Clearly, the Lumite fabric could not be utilized as a geotextile fabric for soil erosion and stabilization.

Continuing, it is believed that the combination of the thickness, strength and modulus of the fabrics of the present invention permit high interface friction angles under saturated conditions resulting in superior veneer stability properties as compared to other geotextile structures. In order to demonstrate this particular improvement over conventional geotextile structures, an interface direct shear test was conducted to evaluate the interface shear resistance between a soaked site cover soil and the geotextile fabric of the present invention.

More particularly, the test included three interface direct shear test trials, each of which was conducted at a different level of normal stress of about 100, 200 and 400 pounds per square foot (lbs/sq. ft.), respectively, using a freshly prepared test specimen of woven geotextile fabric embodying the concepts of the present invention for each trial. The same levels were employed for consolidation stress. The rate of shear for each trial was 0.04 inches per minute. The configuration of the trial specimens used in the tests were, from top to bottom, site cover soil, the geotextile fabric, and site cover soil. For each test trial, the upper cover soil was compacted directly on the geotextile fabric specimen and the entire trial specimen was tested under submerged conditions.

More specifically, the interface direct shear test was generally performed in accordance with ASTM Test Method D 5321, "Determining the Coefficient of Soil and Geosynthetic or Geosynthetic and Geosynthetic Friction by the Direct Shear Method," said method being hereby incorporated by reference. The test trials were conducted in a large direct shear device which includes a shear box comprising an upper component and a lower component. The upper component measured 12 inches by 12 inches (300 mm×300 mm) in plan and 3 inches (75 mm) in depth. The lower component measured 12 inches by 14 inches (300 mm×360 mm) in plan and 3 inches (75 mm) in depth.

A fresh test specimen made from Fabric 2 as noted hereinabove was prepared for each of the three trials. Each geotextile fabric specimen was placed on the top of the compacted site cover soil in the lower shear box and attached to the lower shear box with mechanical compression clamps to confine failure to the interface between the upper site cover and the geotextile fabric.

For each test, fresh specimens of the site cover soil were compacted into the lower shear box and were compacted directly on the geotextile fabric in the upper shear box. The site cover soil was compacted under as-received moisture conditions by hand tamping to the dry unit weight reported in Table IV for each normal stress condition. The reported moisture content and dry unit weight shown in Table IV are average values of the site cover soil in the lower and upper shear boxes. The reported values of dry unit weight were determined by measuring the as-placed volume of soil and dividing this volume into the calculated total dry weight of the soil specimen.

TABLE IV

Summary of Actual Interface Direct Shear Test Equipment and Conditions

| Test Trial No. | 1 | 2 | 3 |
|---|---|---|---|
| Shear Box Size | 12" × 12" | 12" × 12" | 12" × 12" |
| TEST CONDITIONS: | | | |
| $\gamma_{di}$[1] | 97.5 lbs/ cu. ft. | 96.9 lbs/ cu. ft. | 97.2 lbs/ cu. ft. |
| $\omega_{ci}$[2] | 10.8% | 10.5% | 11.2% |
| Consolidation Stress | 100 lbs/sq. ft. | 200 lbs/sq. ft. | 400 lbs/sq. ft. |
| Time of Consolidation | 0 hours | 0 hours | 0 hours |
| $\omega_{cf}$[3] | 14.9% | 16.2% | 16.1% |
| Normal Stress | 100 lbs/sq. ft. | 200 lbs/sq. ft. | 400 lbs/sq. ft. |
| Displacement Rate | 0.04 in/min | 0.04 in/min | 0.04 in/min |

[1] $\gamma_{di}$ refers to average initial dry unit weight of soil specimen in the upper and lower shear boxes in pounds/cubic feet (lbs/cu. ft.).
[2] $\omega_{ci}$ refers to average initial moisture content of soil specimen in the upper and lower shear boxes.
[3] $\omega_{cf}$ refers to average final moisture content of soil specimen in the upper and lower shear boxes.

In addition, for each test, the entire test trial specimen, which included the site cover soil in the lower and upper shear boxes and the geotextile fabric of the present invention, was submerged in tap water for approximately two to four minutes prior to applying normal stress. The entire test specimen remained submerged throughout each test. Furthermore, each specimen was sheared at a constant displacement rate of about 0.04 inches/minute immediately after application of the normal stress. The direction of shear for each test was in the direction of manufacture (warp direction) of the fabric samples. All of the trials were performed using a constant effective sample area, where the geotextile fabric was larger than the upper shear box. Consequently, no area correction was required when computing shear stresses. All of the trails were sheared until a constant, residual load was recorded.

The total stress interface shearing resistance was evaluated for each applied normal stress. The peak value of shear force was used to calculate the peak shear strength, and the residual shear strength was calculated from the stabilized, post-peak shear force which occurred at the end of each test. The total stress peak and residual shear strengths were derived from the test results plotted on a graph (not shown) and are presented in Table V hereinbelow.

TABLE V

Interface Direct Shear Test Results
Measured Peak and Residual Total Shear Strengths

| Test Trial Number | Normal Stress | Measured Peak Shear Strength | Measured Residual Shear Strength |
|---|---|---|---|
| 1 | 100 lbs/sq. ft. | 95 lbs/sq. ft. | 95 lbs/sq. ft. |
| 2 | 200 lbs/sq. ft. | 150 lbs/sq. ft. | 150 lbs/sq. ft. |
| 3 | 400 lbs/sq. ft. | 280 lbs/sq. ft. | 280 lbs/sq. ft. |

Upon calculation of the shear strengths obtained for each test trial, the results were then plotted on a graph (not shown)

of shear stress versus the corresponding normal stress to evaluate a total stress peak or residual strength envelope. A best fit straight line was drawn through the three data points from the test trials to obtain a total peak stress and residual stress interface friction angle and adhesion. The interface friction angles and adhesions derived from the plotted test results are summarized in Table VI hereinbelow.

TABLE VI

Interface Direct Shear Test Results
Measured Total Stress Shear Strength Parameters
Tested Soaked Site Cover Soil/Fabric 2 Interface
(100 to 400 lbs/sq. ft.)

| | |
|---|---|
| PEAK STRENGTH: | |
| Friction Angle | 32° |
| Adhesion | 30 lbs/sq. ft. |
| RESIDUAL STRENGTH: | |
| Friction Angle | 32° |
| Adhesion | 30 lbs/sq. ft. |

For these tests, it is noted that the reported adhesion of 30 lbs/sq. ft. corresponds to the shear axis intercept of the best fit straight line drawn through the test data points on the shear stress versus normal stress graph (not shown). This value may or may not be the true adhesion of the interface and caution should be exercised in using this adhesion value for applications involving normal stresses outside the range of stresses covered by the test.

More notably, an interface friction angle of 32° under saturated conditions was obtained. This angle is approximately 15.6 percent higher than any other interface friction angle obtained under saturated conditions with a soil reinforcement material. The best previous soil reinforcement material obtained only a 27° interface friction angle under saturated conditions. In view of these results, it is believed that the fabric of the present invention can improve the slope stability of slopes having from about 10° to 90° angles (vertical slopes) as may be found in landfills, highways and the like. In this test, it is dear that the fabric of the present invention can improve slope stability of 2.5 H:1 V side slopes (slopes of 22°).

Thus it should be evident that the geotextile fabric and method of the present invention are highly effective in soil stabilization and retention and vegetative reinforcement. The invention is particularly suited for use on slopes, embankments, drainage ditches, subgrades, roadside beds, shorelines, and river or sea walls, but is not necessarily limited thereto. The geotextile fabric of the present invention can also be used with other systems for vegetative reinforcement and erosion control, although such systems are no longer required when the geotextile fabric of the present invention is employed.

Based upon the foregoing disclosure, it should now be apparent that the use of the geotextile fabric and method of use described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, the geotextile fabric of the present invention is not necessarily limited to those comprising thermoplastic materials. Moreover, as noted hereinabove, any conventional method for production of the fabric can be used. Thus, the scope of the invention shall include all modifications and variations that may fall within the scope of the attached claims.

What is claimed is:

1. A method of stabilizing soil and reinforcing vegetation comprising:

placing a single-layered, three-dimensional, high-profile woven geotextile fabric into soil, wherein said fabric comprises two sets of monofilaments interwoven in a substantially perpendicular direction to each other, each said monofilament of each set being arranged so as to shrink upon heating to a predetermined level dependent upon the position of said filament in the woven fabric, thereby forming a single-layer, three-dimensional, cuspated profile.

2. The method, as set forth in claim 1, further comprising:

covering said fabric with a layer of soil.

3. The method, as set forth in claim 1, wherein said fabric has a tensile strength of at least about 3200 pounds/foot in the warp direction and at least about 2400 pounds/foot in the filling direction, a modulus at 10 percent elongation of at least about 12500 pounds/foot in the warp direction and at least about 11000 pounds/foot in the filling direction, and a thickness of at least about 500 mils.

4. The method, as set forth in claim 2, wherein a resulting interface friction angle between said soil and said fabric of at least about 32° is provided.

5. The method, as set forth in claim 4, wherein said step of placing said fabric may be performed on side slopes having about 10° to 90° angles.

* * * * *